US006834836B2

(12) United States Patent
Heywood

(10) Patent No.: US 6,834,836 B2
(45) Date of Patent: Dec. 28, 2004

(54) BINARY DATA TRANSMISSION CAPABILITY INCORPORATED INTO PULSE CODED RAILROAD SIGNALING SYSTEM

(75) Inventor: Timothy Charles Heywood, Honeoye Falls, NY (US)

(73) Assignee: Alstom Signaling, Inc., Rochester, NY (US)

( * ) Notice: Subject to any disclaimer, the term of this patent is extended or adjusted under 35 U.S.C. 154(b) by 0 days.

(21) Appl. No.: 10/345,614

(22) Filed: Jan. 16, 2003

(65) Prior Publication Data

US 2003/0136882 A1 Jul. 24, 2003

Related U.S. Application Data

(60) Provisional application No. 60/350,690, filed on Jan. 22, 2002.

(51) Int. Cl.[7] ..... B61L 23/00

(52) U.S. Cl. ..... 246/120; 246/167 R; 340/825.57; 375/260

(58) Field of Search ..... 246/1 R, 2 R, 246/120, 122, 167 R, 473 R; 340/825.57, 825.69, 870.11, 870.12, 340, 3.1; 455/296; 375/260, 259, 255, 256, 346, 348

(56) References Cited

U.S. PATENT DOCUMENTS

| | | | | | |
|---|---|---|---|---|---|
| 3,751,638 | A | * | 8/1973 | Mooers | 370/527 |
| 5,673,252 | A | * | 9/1997 | Johnson et al. | 370/449 |
| 6,216,985 | B1 | * | 4/2001 | Stephens | 246/120 |
| 6,452,986 | B1 | * | 9/2002 | Luxford et al. | 375/343 |

* cited by examiner

*Primary Examiner*—Frantz F. Jules
(74) *Attorney, Agent, or Firm*—Ohlandt, Greeley Ruggiero & Perle

(57) ABSTRACT

A railroad signaling system operative for controlling railroad traffic to control signals, said system comprising: a control point; a control block having a plurality of common nodes and a node which serves as a control point; and a common medium which is capable of transmitting the control signals and separate independent messages while precluding interference between said control signals and said independent messages.

8 Claims, 2 Drawing Sheets

Example Railroad Control Block

Example Railroad Control Block

Bi-directional communication on a track circuit

Frame Diagram (simplified)

frame (30 code cycles - approx. 84 seconds to transmit)
k cycle, S = Space cycle, D - Data cycle, P = Parity cycle, K = Skip cycle frame with 1 Skip (31 code cycles - approx. 87 seconds to transmit)

BINARY DATA TRANSMISSION CAPABILITY INCORPORATED INTO PULSE CODED RAILROAD SIGNALING SYSTEM

Priority of U.S. Provisional Application Ser. No. 60/350,690 filed on Jan. 22, 2002, is claimed under 35 U.S.C. §119(e).

FIELD OF THE INVENTION

The present invention relates to a pulse coded railroad signaling system and, more particularly, to a scheme for efficiently incorporating a binary data capability into the system by utilizing the same medium of transmission without interfering with the operation of the signaling system.

BACKGROUND OF THE INVENTION

Prior to this invention, railroads generally had no remote access to data at nodes other than Control Points. If it was desired by a railroad to have access to maintenance-related information at every node in a pulse coded signaling system, the railroad would have to install telephone lines or data radios at every node to relay this information back to the control office. This would be prohibitively expensive for most railroads. In fact, the development of pulse coded signaling systems using the rails as a transmission medium occurred precisely to enable the railroad to eliminate the costly wires previously run to every signaling node (also known as a 'pole-line') to carry vital signaling information.

In the present context, binary data transmission is defined as the transmission of messages composed of multiple binary data bits, where a binary data bit is the smallest quantum of information, having a value of 0 or 1. It will be helpful to describe current pulse coded railroad signaling systems to provide a background for understanding the invention. Current pulse coded railroad signaling systems convey vital (fail-safe) and non-vital signaling information through the rails from each end of a control block (called Control Points) to each node of the signaling system in the block. The block is defined to be a distance of railroad track (often many miles) which is terminated on each end by a Control Point and divided into a number of track circuits. A track circuit is defined as a section of railroad track that is electrically isolated from the other adjacent sections of track. Electronic equipment connects to each end of a given track circuit and, with the equipment at each end acting alternately as transmitter and receiver, uses the track as a communications medium to transmit information. An example of this type of electronic equipment is the ALSTOM Genrakode™ product line. The vital and non-vital information transmitted through the track circuits is used to control wayside signals and for other control functions. The term node is used to describe a single instance of this electronic equipment that may communicate with one or two track circuits depending on the location of the nodes in the block. The nodes at each end of the block (Control Points) need only communicate with one track circuit whereas the other nodes (Intermediates, Repeaters, and Switch Locks) generally communicate with the two track circuits on either side of a track circuit boundary.

Control Points are so named because they are the nodes with direct communications links to the central control office for control of train routing. Intermediates are nodes that drive intermediate signals to control train movements. Repeaters are used where track circuit length between other nodes is too great and it is necessary to bridge the distance between two nodes. Switch Locks are used to electrically control access to a hand-throw track switch mechanism in a fail-safe manner. Communications between each adjacent node occurs on a nominal 2.8 second cycle time (although other cycle times may be used). Each node is a transceiver, which transmits for half of the cycle and receives for the other half of the cycle. The conventional vital signaling information is not binary. The data in each cycle can be one of several values (termed codes) as opposed to only two values (0 or 1). The codes are decoded and used by the system on a cycle-by-cycle basis. This type of system performs no encoding/decoding of data over multiple cycles, with the one exception being the Alternating Code 5 mode which uses data from two consecutive cycles for decoding.

The signaling information is represented by a limited number of codes, only one (two in special cases) of which is encoded per cycle. Each node can only receive codes from adjacent nodes (which are typically located 1–3 miles apart). Therefore, as shown in FIG. 1, Node 1 is only receiving codes transmitted directly from Node 2. This is adequate for operation of the signaling system; however, it would also be desirable to have the capability to transmit specific information from a node to any other node in the block. A specific example of this would be the capability to transmit maintenance-related information such as a burned-out signal bulb from the Wayside Signal location at Node 3 to Control Point A (Node 1), so this specific information may be passed on to the central control office. With this information, the control office can alert maintenance personnel to the exact location and nature of a problem to allow immediate corrective action to be taken to minimize or prevent train delays.

Accordingly, a primary object of the present invention is to enable an efficiently operating scheme to report on maintenance and other problems over a common railway signaling transmission means.

SUMMARY OF THE INVENTION

The present invention conveys maintenance-related data (or any other non-vital information) to from any node using the same transmission medium (the rails) as the pulse coded vital signaling. This data can therefore be sent to the Control Points where a communication link to the central control office already exists. Since this new communication capability takes advantage of an existing transmission medium and existing hardware (the current signaling system), the cost to utilize this new capability is minimal.

This invention provides the above-noted capability by overlaying a binary data protocol on the existing pulse coding scheme to send binary data from any node in the block to any other node, and thence to a control point, while not interfering with the existing operation of the signaling system.

The invention can be used in commercial applications to transmit specific information from any one node to any other node in a pulse coded railroad signaling system, which is not currently possible. The most obvious example of this (cited as an example in the previous section) is maintenance-related information.

The foregoing and still further objects and advantages of the present invention will be more apparent from the following detailed explanation of the preferred embodiments of the invention in connection with the accompanying drawing.

DETAILED DESCRIPTION OF PREFERRED EMBODIMENT

Figure 2:
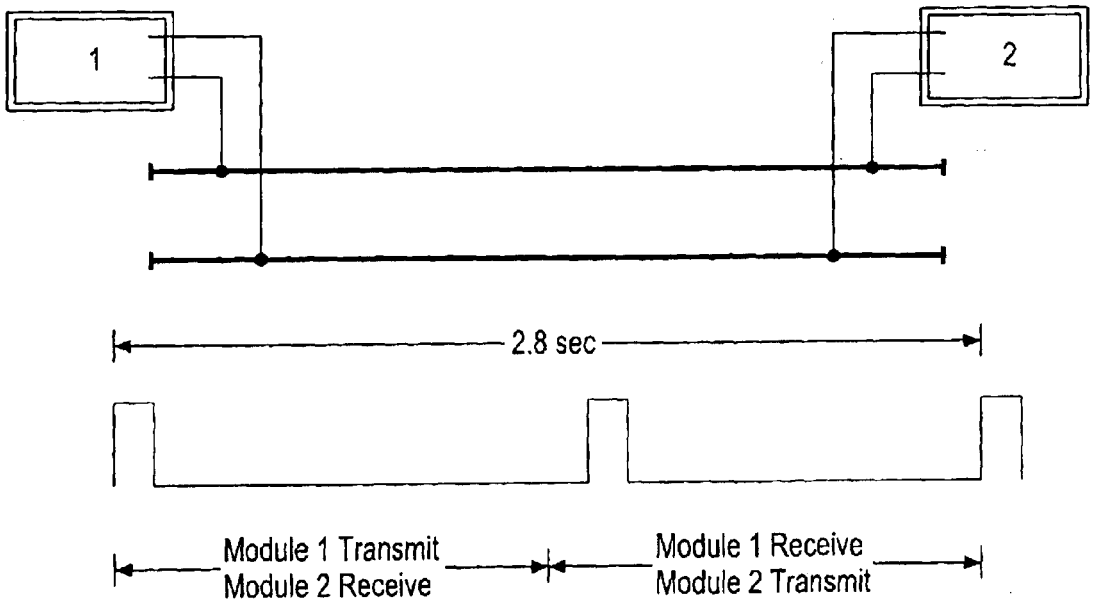
FIG. 2 depicts bi-directional communication on a track circuit in such signaling systems.

In order to provide a complete understanding of known practices, pulse coded railroad signaling systems using the rails as a transmission medium were originally developed in the 1970's to provide vital (fail-safe) control of the signaling system without the use of traditional pole line, which railroad found increasingly expensive and inconvenient to maintain. These systems are composed of various transceiver stations or nodes at opposite ends of track circuits (discrete sections of track electrically isolated by insulated joints—typically one to three miles in length). Each node is located on the boundary of two track circuits defined by the insulated joints (see FIG. 2). These nodes exchange electrical signals through the track circuit in a time sharing mode with a fixed cycle time (typically 2.8 seconds). Communication is bi-directional, where Node 1 may transmit for 1.4 seconds while Node 2 receives and then Node 2 transmits to Node 1 for the final 1.4 seconds of the cycle. The electrical signals are typically DC current pulses, although AC pulses are used on railroad properties where electrically powered locomotives operate such that DC pulse operation is not possible.

Figure 1:
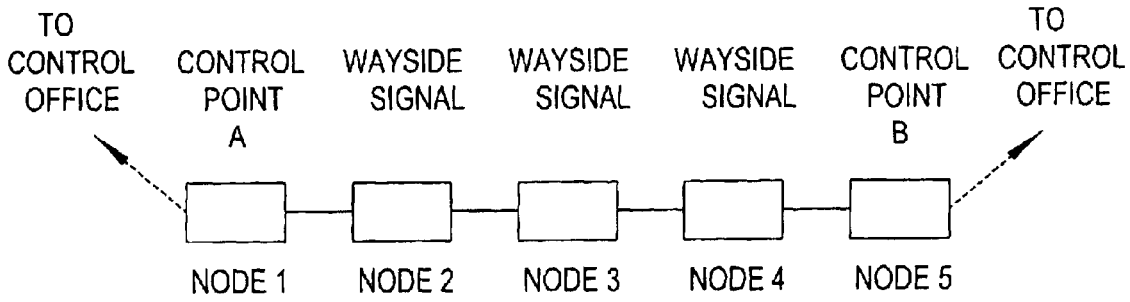
FIG. 1 is a block diagram depicting an exemplary railroad control block found in known signaling systems.

Different combinations of pulses are produced by the transceiver nodes by varying the number of pulses, spacing between multiple pulses (if present), and pulse length, to represent different codes. These nodes transmit and receive these codes to/from their adjacent nodes based on the operating rules of the railroad to control safety-critical wayside equipment such as signals and switch controllers. Except for the transceiver nodes at the end of each control block (the Control Points), each transceiver node only directly communicates with the node at the end of its track circuit (referring to FIG. 1, Node 1 can only directly communicate with Node 2).

A fundamental limitation of this design is that the Control Point only has direct knowledge of the code(s) being transmitted by its one adjacent node, and has no direct knowledge of the specific codes being transmitted by other nodes in the block. One prior approach to providing maintenance-related data from nodes out in the block to the Control Points has been to define a non-vital maintenance code (Code M) which can be added to most of the other codes by modifying pulse widths. In practice, if any node in the block were to experience a system fault (e.g. a failed signal lamp filament), the node would add Code M to the code(s) it is currently transmitting. This would be repeated as necessary by other nodes until the code reaches a Control Point, at which time an indication could be generated to the control office that some fault is present at some node in the control block, although no information is available on the nature of the fault or the exact location of the fault.

The present invention provides the capability for any node in the control block to transmit specific data to any other node in the block while not compromising the underlying operation of the pulse coded signaling system. This capability can be used for many purposes including providing maintenance-related information from any node to the control office via the Control Points.

With this invention, if any node in the block were to experience a system fault (e.g. a failed signal lamp filament), the node would transmit data which uniquely identified both the location and nature of the fault to one or both of its adjacent nodes. This would be logged and repeated as necessary by other nodes until the data reaches a Control Point, at which time this data could be relayed to the control office, providing the exact location and nature of the fault. This will allow much faster alerting and dispatching of maintenance personnel to correct the fault and minimize train delays. In many cases, it may allow a problem to be detected and corrected before it could cause a train delay. With current systems, failed lamp filaments must be reported by train crews and result in stopped trains or trains proceeding at reduced speeds which adversely affects railroad operations.

This new data transmission capability is achieved by encoding a multi-bit binary message over multiple cycles of the track code transmit/receive process. The definition of codes within current pulse coded signaling systems is limited to a single transmit/receive cycle period (typically 2.8 seconds). In other words, for a given transceiver in one cycle period, only one code (or code combination) can be received and transmitted.

The data transmission protocol being proposed encodes data on top of the existing codes by slightly modifying their pulse widths. The modified pulse width values are chosen so as to not interfere with the normal operation of the signaling system, and in fact to be completely transparent to normal operation. Because the minimum bit period for this encoding is limited to 32.8 seconds at the typical period, the maximum achievable data rate is quite slow (maximum of 0.35 bits per second). In the application described below, the actual data rate is even slower because, for operational reasons, more than one cycle is used to encode each data bit. This data rate is adequate for any data that has no specific timing requirements, such as maintenance-related information.

The present invention is preferably used in a Code T Mode system, which allows transmission of maintenance information (Trouble Codes) from transceivers in a control block to one or both control points at each end of the block to provide maintenance personnel information on the location and nature of events requiring maintenance action.

Use of the Code T mode requires all modules in the block to be modules with appropriate software versions and enable settings.

Code Definitions

To describe the coding scheme used for the Code T Mode it is necessary to describe one type of coding format for signaling codes commonly used in the industry. There are eight standalone codes; that is, one or two pulse codes that are uniquely described by pulse widths and spacings. These are the codes that are transmitted and received by nodes in the signaling system to control wayside signals and other equipment. The typical timing characteristics are:

| Code | Pulse 1 width (in milliseconds) | Pulse 2 width (in milliseconds | Pulse spacing (in milliseconds) |
|---|---|---|---|
| 1 | 112 | none | n/a |
| 2 | 112 | 112 | 688 |
| 3 | 112 | 112 | 496 |
| 4 | 112 | 112 | 320 |
| 6 | 600 | none | n/a |
| 7 | 112 | 112 | 224 |
| 8 | 112 | 112 | 944 |
| 9 | 112 | 112 | 816 |

As an example, if two pulses are received in a cycle where each pulse is 112 ms long and the rising-edge to rising-edge spacing is 816 ms, the system declares it received a Code 9 for that cycle.

There is also a non vital code designated Code 5, which can be encoded on all codes except Code 6. Code 5 is combined with one of these codes by extending the width of one pulse. The typical timing characteristics are:

| Code | Pulse 1 width (in milliseconds) | Pulse 2 width (in milliseconds | Pulse spacing (in milliseconds) |
|---|---|---|---|
| 1&5 | 224 | none | n/a |
| 2&5 | 224 | 112 | 688 |
| 3&5 | 112 | 224 | 496 |
| 4&5 | 112 | 224 | 320 |
| 7&5 | 112 | 224 | 224 |
| 8&5 | 224 | 112 | 944 |
| 9&5 | 224 | 112 | 816 |

As shown in Table 2, Code 5 is encoded on a standalone code by extending one of the pulses from 112 ms to 224 ms. For example, when two pulses are received in a cycle where the first is 112 ms long and the second is 224 ms long, and the rising-edge to rising-edge spacing is 320 ms, the system declares it received a Code 4 and a Code 5 for that cycle.

Binary Data Frame Description

A single binary message is encoded over a multi-cycle frame. The number of cycles required to transmit one frame is based on the message length. The message length is a function of the maximum number of track circuits in a block and the number of unique Trouble Codes required. The Code T Mode currently supports four Trouble Codes per location although this is arbitrary. This means that up to four distinct faults or indications can be reported per node.

The largest block supported by the Code T Mode is 28 track circuits (27 locations that can generate a Trouble Code) although this length is arbitrary. Seven bits are required to encode the resulting 108 unique Trouble Codes. A frame is defined as the group of code cycles required to send a single Trouble Code represented by a 7-bit binary value. The Trouble Code is encoded using Code T, a non-vital code similar to Code 5 in that it is represented by a modified pulse width on all codes, except Code 6 which cannot carry Code T. The Mark/Space model is used to describe the encoding of the binary data bits in the frame. The typical timing characteristics for Code T are:

| Code | Pulse 1 width (in milliseconds) | Pulse 2 width (in milliseconds | Pulse spacing (in milliseconds) |
|---|---|---|---|
| 1&T | 512 | none | n/a |
| 2&T | 512 | 112 | 688 |
| 3&T | 112 | 512 | 496 |
| 4&T | 112 | 512 | 320 |
| 7&T | 112 | 512 | 224 |
| 8&T | 512 | 112 | 944 |
| 9&T | 512 | 112 | 816 |

Figure 3:
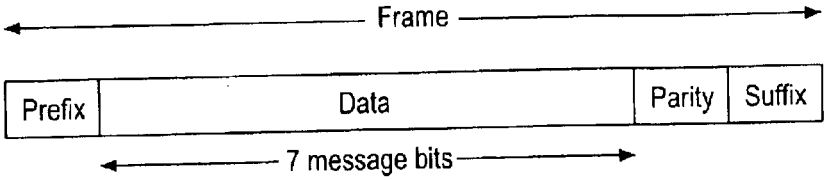
FIG. 3 is a simplified frame diagram that is designed to aid in the understanding of the encoding of messages over a multi-cycle frame.

Each code cycle is defined as containing one of three types of Code T information: A Mark cycle is defined as a code cycle in which Code T is transmitted. A Skip cycle is defined as a code cycle during a Trouble Code frame in which Code 6 is transmitted and the frame sequence is suspended for one cycle. A Space cycle is defined as a code cycle during a Trouble Code frame in which a Code T pulse is not transmitted and Code 6 is not transmitted. A Data cycle is defined as a code cycle during a Trouble Code frame that is either a Mark or Space cycle depending on the state of that particular data bit representing the Trouble Code. A Parity cycle is identical to a Data cycle except that the bit value represents the message parity which is defined as being a '1' if the number of data bits with a '1' value is odd, and a '0' if this number is even. The data frame is defined as a particular sequence of cycles divided into four fields as shown in FIG. 3.

Figure 4A:
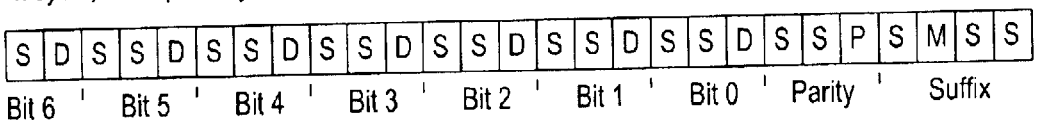
FIGS. 4A and 4B are frame diagrams depicting a normal frame and a normal frame with one strip, respectively.
Figure 4B:
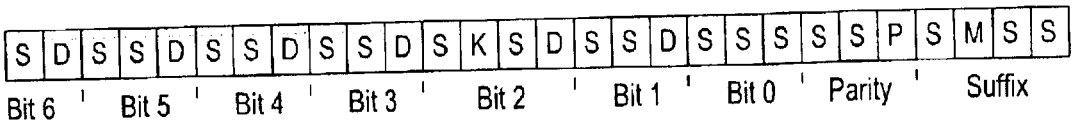

In the current application, each frame begins with a Start Frame prefix consisting of two consecutive Mark cycles, a pattern that is only allowed at the start of the frame. Each of the seven data bits are packaged in a three-cycle sequence beginning with two Space cycles. The third cycle is a Mark cycle if the value of that data bit is '1' and a Space cycle if it is '0'. The most significant bit is sent first. After the least significant bit is transmitted, a parity bit is sent (in the same three-cycle sequence as the data bits) to allow error checking at the receiver, followed by an End Frame suffix (Space-Mark-Space-Space sequence) to indicate the end of the frame. A complete data frame sequence therefore consists of thirty code cycles plus the number of Skip cycles (cycles in which Code 6 is transmitted) which may occur during the transmission of the frame. When Code 6 is transmitted (typically for a single code cycle only), the frame sequence is simply suspended for that cycle, then resumed exactly where the sequence left off. Example frame sequences are shown in FIG. 4, with and without a Skip cycle present. This frame sequence is designed to reduce the likelihood of false alarms, cause no interference to the transmission of Code 5 or 6, and maximize the speed of Trouble Code transmission. The size of the frame could be expanded to any arbitrary data packet size; seven bits are used because it is the minimum message size required for this particular application. Tailoring the message size to the application is desirable to maximize the effective data rate. Likewise, the exact number of cycles used for the Start Frame prefix, frame Parity, End Frame suffix, and the number of cycles used to represent each data bit could be altered to optimize the effective data rate for a given application without altering the basic character of the invention.

Code T Transmit/Decoding Rules

Only properly configured modules can transmit and receive Trouble Codes. A Trouble Code will be transmitted by a module when either of the following conditions is met:

1. One of the module's four trouble code parameters is set True by the application logic. This trouble code will be sent in both directions (unless otherwise configured).

2. A Trouble Code is received from an adjacent node. This trouble code will not be sent in both directions; it will only be repeated (e.g. if received on the East, it will be transmitted to the West).

If communications between two nodes is broken (even for a single cycle) while a Trouble Code is being sent, both ends of the circuit will reset their Code T processes: the transmitting node will wait until communication is re-established with the node at the other end of the track circuit to restart the same Trouble Code that was interrupted, and the receiving node will ignore the incomplete Trouble Code frame and wait for another valid frame to begin.

When any node receives a complete, valid Trouble Code frame, that Trouble Code is stored in that node's on-board memory for access by maintenance personnel. For nodes which communicate with two track circuits (i.e., any nodes other than Control Points), that received Trouble Code is also queued up for transmit on the other track.

It will be understood that the protocol described avoids interference with the normal operation of the signaling system by choosing pulse widths representing the encoding of binary data (both 0's and 1's) that also represent the normal 'cycle-by-cycle' signaling code being sent from one node to another. In this way, one or two-pulse codes can still be transmitted through the block from one node to another in the conventional way (where the pulse(s) received in a single cycle represent the current signaling code), but the pulse widths of those codes may vary over a group of cycles (a binary data frame) to encode a digital message. Each node would typically evaluate the incoming track pulses in two separate processes: 1) evaluate the pulses received in the current cycle to determine the current signaling code for that cycle (used to determine signal aspect to display, relay output to energize, track code to transmit, etc.), and 2) evaluate the pulses received in the current cycle to extract an encoded binary bit which is combined with some previously received n bits (based on the actual protocol as implemented) to assemble a binary message. The data content of a received binary message may be used for any arbitrary function by the receiving node and/or transmitted on to the next node (and ultimately the Control Points).

Although the described initial application of this invention involves unidirectional transmission, it will be understood by those skilled in the art that bi-directional communications from a central point to nodules (in the block schemes depicted) would also be feasible.

The invention having been thus described with particular reference to the preferred forms thereof, it will be obvious that various changes and modifications may be made therein without departing from the spirit and scope of the invention as defined in the appended claims.

What is claimed is:

1. A railroad signaling system operative for controlling railroad traffic to control signals, said system comprising:

a control point;

a control block having a plurality of common nodes and one of the nodes which serves as a control point; and a common medium which is capable of transmitting the control signals and separate independent messages, including means for precluding interference between said control signals and said independent messages, wherein the control signal are transmitted to and effect operation of adjacent common nodes, whereas the independent messages are transmitted ultimately to the control point node from an originating common node.

2. A system as defined in claim 1, wherein the independent messages relate to supervisory information, and provide the source of the information.

3. A system, as defined in claim 1, wherein the common medium includes the vehicular running rails.

4. A system as defined in claim 1 further comprising a pulse coding scheme and means for transmitting together over the common medium, the pulse coding and independent messages that include binary data.

5. A system as defined in claim 4, further comprising values for encoding the independent messages in multi-bit binary form over multiple cycles of the pulse coding scheme.

6. A system as defined in claim 4, wherein said binary data is encoded over a multi-cycle frame, and the number of cycles required to transmit one frame being based on the length of said independent messages.

7. A scheme as defined in claim 1, wherein the common medium enables transmission without interference between the control signals and the independent messages by (a) selective acceptance to and from adjacent nodes of only the unextended pulses of control signals and (b) selective acceptance at control offices of only the extended pulses of binary data messages.

8. A system as defined in claim 1, wherein several control offices are included and one of the common nodes is directly connected to each of the control offices.

* * * * *